US005189308A

United States Patent [19]

Kortlang et al.

[11] Patent Number: 5,189,308

[45] Date of Patent: Feb. 23, 1993

[54] BALE OPENER HAVING DUAL SENSORS CONNECTED TO A SURFACE INCLINATION CONTROL DEVICE

[75] Inventors: Wolfgang Kortlang, Mönchengladbach; Josef Temburg, Jüchen; Johann Zander, Mönchengladbach, all of Fed. Rep. of Germany

[73] Assignee: Trützschler GmbH & Co. KG, Mönchengladbach, Fed. Rep. of Germany

[21] Appl. No.: 857,576

[22] Filed: Mar. 27, 1992

[30] Foreign Application Priority Data

Mar. 27, 1991 [DE] Fed. Rep. of Germany ..... 4110074

[51] Int. Cl.[5] ..... G01V 9/04

[52] U.S. Cl. ..... 250/561; 250/223 R; 356/376; 19/80 R

[58] Field of Search ..... 250/561, 223 R; 356/376; 19/80 R, 81, 83, 85, 145.5

[56] References Cited

U.S. PATENT DOCUMENTS 4,785,504 11/1988 Leifeld et al. ..... 19/80 R
5,090,091 2/1992 Temburg et al. ..... 19/80 R

FOREIGN PATENT DOCUMENTS 2742016 3/1979 Fed. Rep. of Germany .
3135272 3/1983 Fed. Rep. of Germany .
3335793 4/1985 Fed. Rep. of Germany .
3730487 6/1989 Fed. Rep. of Germany .

*Primary Examiner*—David C. Nelms
*Assistant Examiner*—Que T. Le
*Attorney, Agent, or Firm*—Spencer, Frank & Schneider

[57] ABSTRACT

A bale opener includes a tower arranged for horizontal travel in a travelling direction along a stationarily supported fiber bale series; a detaching assembly mounted on the tower and projecting laterally therefrom to extend above an upper surface of the bale series; an opening device forming part of the detaching assembly for removing fiber tufts from the upper surface in an oblique plane during travel of the bale opener tower; at least two surface level sensors mounted on the detaching assembly for determining a height level of the upper suface at different locations during the horizontal travel of the bale opener; a path sensor for determining coordinates of the different locations; and a control device for determining the inclination of the upper surface from the height levels of the upper surface at the different locations. The surface level sensors and the path sensor are connected to the control device.

15 Claims, 5 Drawing Sheets

BALE OPENER HAVING DUAL SENSORS CONNECTED TO A SURFACE INCLINATION CONTROL DEVICE

CROSS REFERENCE TO RELATED APPLICATION

This application claims the priority of German Application No. P 41 10 074.3 filed Mar. 27, 1991, which is incorporated herein by reference.

BACKGROUND OF THE INVENTION

The invention relates to a method and an apparatus for operating a fiber bale opener, particularly for determining the upper surface boundary of textile fiber bales wherein a fiber tuft detaching (opening) device, provided with at least one rapidly rotating opening roll, is moved above the fiber bales. For measuring the upper surface boundaries, at least two sensors are utilized which are spaced from one another in the travelling direction of the bale opener and which are moved vertically.

According to a known method, the detaching device of the bale opener travels in a horizontal direction above a bale series, that is, the upper surface worked by the detaching device lies in a horizontal plane. The worked-on surface (hereafter also termed a "working surface") and the upper bale boundary of the bale series coincide and both are horizontally oriented. In such a process only the height of the fiber bales, that is, the upper horizontal bale boundary can be determined. Such measurement is effected only once, at the beginning of the detaching process. Thereafter, the stationarily supported fiber bales are abraded in a vertical direction, for example, by means of an opening roll until entire fiber bales are consumed in their entirety. A continuous feed (addition) of new fiber bales to the bales of the series that is worked on, that is, a continuous detaching operation by the fiber bale opener is not feasible.

SUMMARY OF THE INVENTION

It is an object of the invention to provide an improved method and apparatus of the above-outlined type with which the discussed disadvantages are eliminated and which, in particular, makes possible a continuous fiber tuft detaching operation on the fiber bales and, upon an interruption of the operation provides for a determination of the upper bale boundary of the working surface of the bale series.

This object and others to become apparent as the specification progresses, are accomplished by the invention, according to which, briefly stated, the bale opener includes a tower arranged for horizontal travel in a travelling direction along a stationarily supported fiber bale series; a detaching assembly mounted on the tower and projecting laterally therefrom to extend above an upper surface of the bale series; an opening device forming part of the detaching assembly for removing fiber tufts from the upper surface in an oblique plane during travel of the bale opener tower; at least two surface level sensors mounted on the detaching assembly for determining a height level of the upper surface at different locations during the horizontal travel of the bale opener; a path sensor for determining coordinates of the different locations; and a control device for determining the inclination of the upper surface from the height levels of the upper surface at the different locations.

The surface level sensors and the path sensor are connected to the control device.

Thus, according to the invention, the obliquely oriented working surface forms an inclined angle with, and adjoins the upper horizontal bale surface of the bale series. There is effected a continuous feed of new (full height) fiber bales which are added to the bale series that is being worked on, so that a continuous detaching operation may take place which thus does not stop when a fiber bale is entirely consumed. After a longer interruption between two working periods, that is, after an extended air conditioning period, the fiber bales expand in the vertical direction to different degrees whereby a new angle of inclination is present. It may furthermore occur that because of a programming error the then operative inclined working plane becomes lost. The invention provides that the new oblique operational angle is automatically determined anew so that a continued operation without manual intervention may take place automatically.

Expediently, the sensors are moved along the inclined plane simultaneously vertically and in the longitudinal direction and from a determined pivotal angle and longitudinal positions the inclined bale boundary is determined.

DESCRIPTION OF THE PREFERRED EMBODIMENTS

Figure 1A:
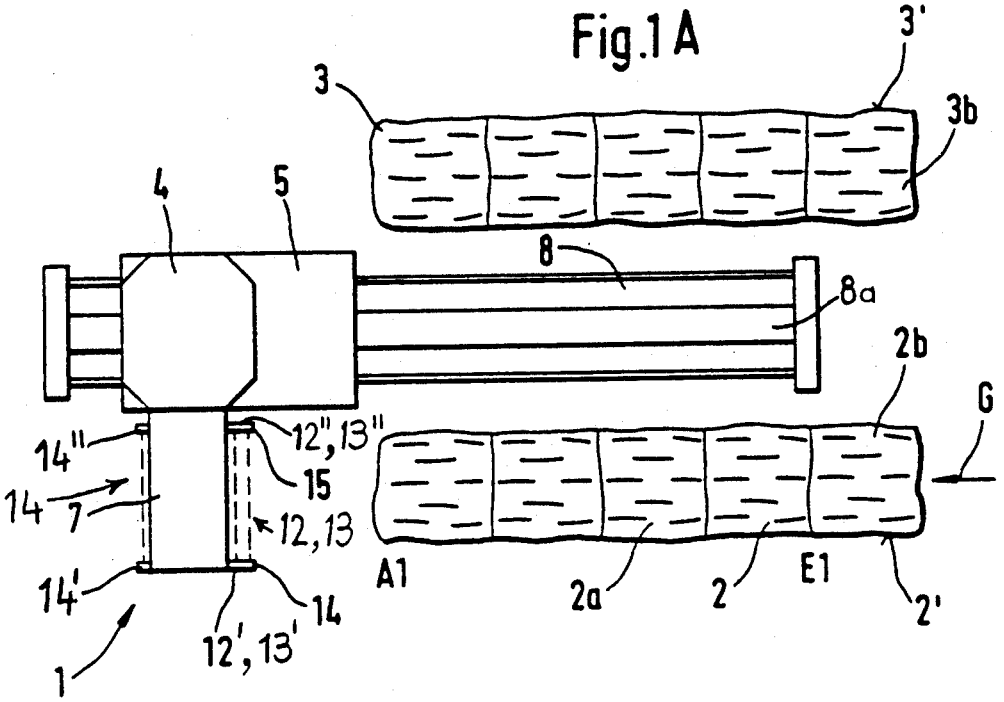
FIG. 1A is a schematic top plan view of a bale opener having a cantilevered fiber tuft detaching assembly provided with a plurality of optical sensors according to a preferred embodiment of the invention.
Figure 1B:
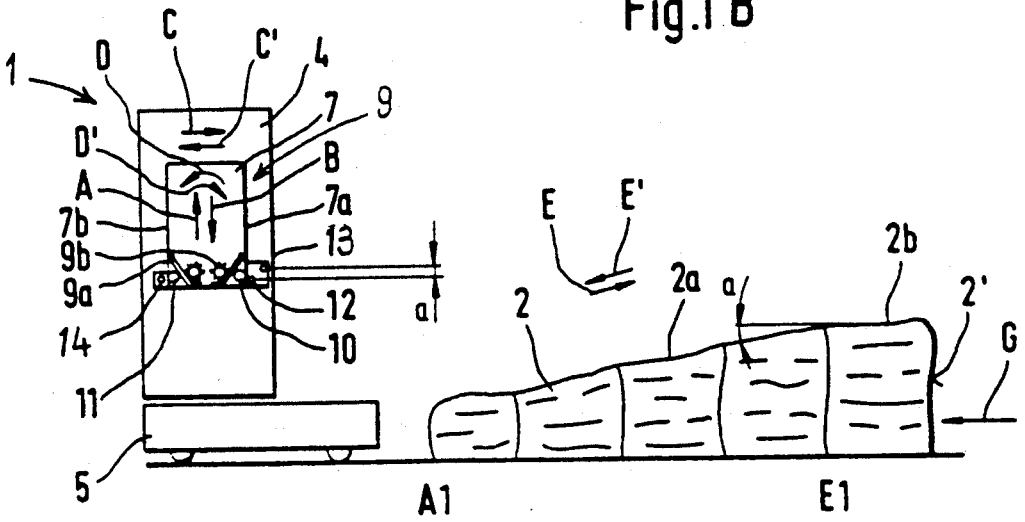
FIG. 1B is a schematic side elevational view of the construction shown in FIG. 1A.

Turning to FIGS. 1A and 1B, there is illustrated therein a bale opener generally designated at 1 which may be of the general construction of a BLENDOMAT model, manufactured by Trützschler GmbH & Co. KG, Mönchengladbach, Germany. The bale opener 1 has a carriage 5 which travels back and forth on a track 8 between two parallel-arranged series of stationarily supported fiber bales 2, 3. On the carriage an opener tower 4 is mounted which is rotatable about a vertical axis and which, in turn, carries a laterally projecting fiber tuft detaching assembly 7 which includes a housing 7' and an opening device 9 proper, having two opening rolls **9*a* and 9*b*. The detaching assembly 7 may be vertically movable in the directions of arrows A, B relative to the tower 4. Furthermore, the detaching assembly 7 is rotatable about a horizontal axis which is perpendicular to the travelling direction C, C' of the bale opener 1. Such a rotation of the detaching assembly 7** in a vertical plane is designated by arrows D and D'.

As the bale opener 1 travels along the fiber bales, the opening device 9 removes fiber tufts from the upper surface of the bales. The fiber tufts are conventionally removed by suction through the cantilever housing 7', the bale opener tower 4 and a channel 8*a* extending along the tracks 8.

FIG. 1A depicts an operational phase where the detaching assembly 7 has been swung about a vertical axis into the path of the fiber bale series 2 so that fiber tuft removal occurs from the bale series 2. In its forward travel the bale opener 1 moves from the beginning A1 of the bale series 2 to the end E1 thereof and thereafter the bale opener 1 moves from the end E1 to the beginning A1 in its reverse travel. During such travels, the opening device 9 moves along the inclined working surfaces 2*a* in the direction of the arrows E, E'. At the vertical end face 7*a* of the cantilever housing 7' there are mounted a first optical barrier 12 formed of a transmitter 12' and a receiver 12" and a second optical barrier 13 formed of a transmitter 13' and a receiver 13". The transmitters are in alignment with their respective receivers in a direction parallel to the opening rolls 9*a*, 9*b*. The optical barrier 12 is at a vertical distance a from the optical barrier 13. At least one of the optical barriers 12 or 13 is supported to be adjustable relative to the other optical barrier, whereby the vertical distance a is variable. Further, on the vertical end face 7*b* of the housing 7', opposite the end face 7*a*, the bale opener 1 carries a further optical barrier 14 formed of a transmitter 14' and a receiver 14" for sensing the longitudinal position of the detaching assembly 7 along its travelling path.

As indicated by the arrow G, new full-height fiber bales having a horizontal upper surface are supplied. The upper working face 2*a* of the fiber bales 2 extends obliquely between locations A1 and E1. The oblique working surface 2*a* which adjoins the upper horizontal fiber bale boundary 2*b* of the fiber bale 2' is likewise present in the bale series 3.

Figure 2A:
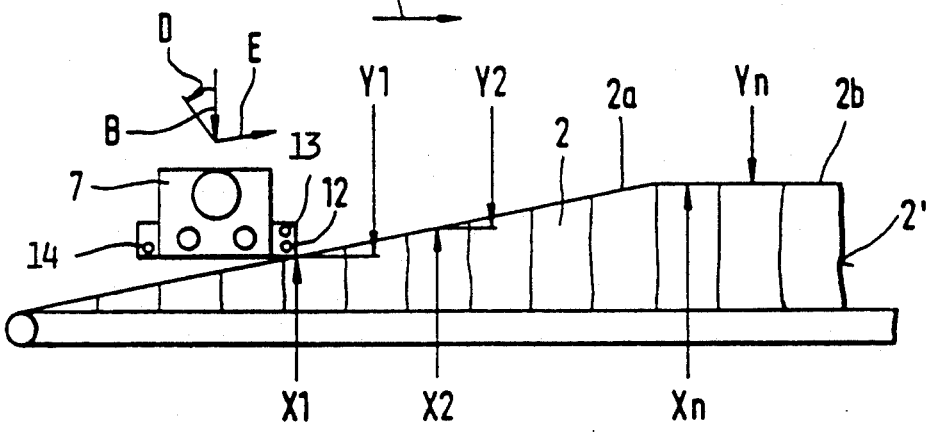
FIGS. 2A–2D are schematic side elevational views illustrating, in particular, positions of sensors which are lowerable and pivotal relative to the bale surface.
Figure 2B:
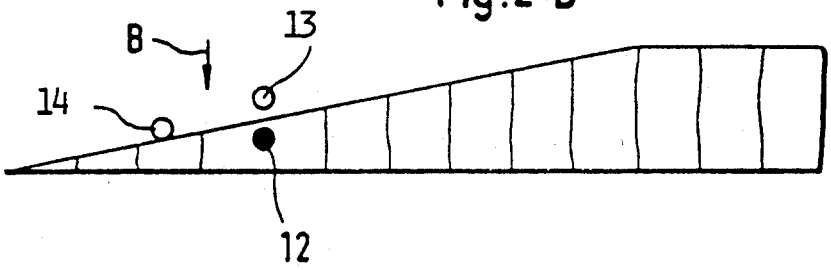
Figure 2C:
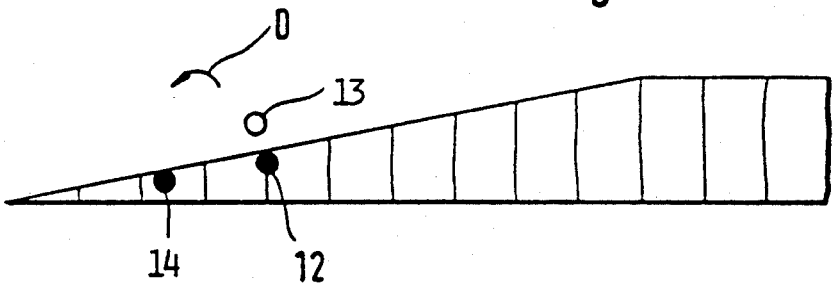
Figure 2D:
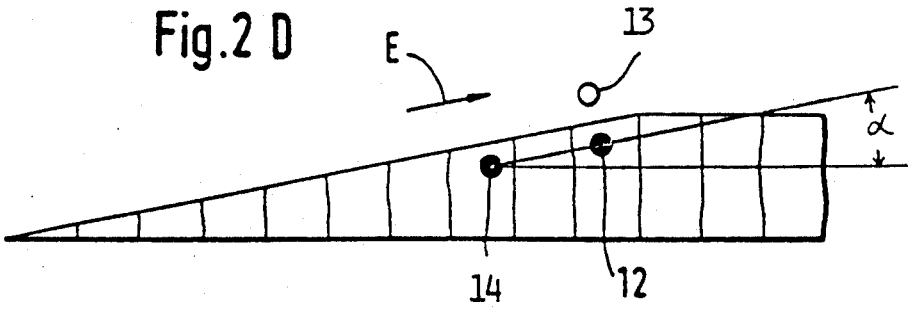

Turning to FIG. 2A, the detaching assembly 7 carries three optical barriers 12, 13 and 14 in which, departing from the FIG. 1B arrangement, the optical barriers 12 and 13 are in vertical alignment with one another. After starting the bale opener 1, the latter is brought into the starting position X1 while the detaching assembly 7 is in its highest position. Thereafter, the detaching assembly 7 is, by a control program inputted into a control device 29 shown in the block diagram of FIG. 5, automatically lowered until the light beam in the optical barrier 12 is interrupted. Thereupon the detaching assembly 7 is pivoted in the direction of the arrow D until the light beam in the optical barrier 14 is interrupted (FIG. 2C). By means of a sensor 27, which is symbolically shown in FIG. 5 and which may be, for example, an angular position determining device, the extent of the pivotal motion is determined in degrees and this information is stored as the oblique working angle in the memory 28, together with the positional coordinates X1, Y1. While the bale opener 1 is subsequently travelling in the direction C, the program controls the position of the detaching assembly 7 in such a manner that the assembly 7 is adjusted in the direction of the arrow E, corresponding to the angle $\alpha$, as shown in FIG. 2D. At regular intervals, the positions during travel are stored. If during such travel, the optical barriers 12 and 14 detect a "light" signal, the upward motion of the detaching assembly 7 is stopped. In case the optical barrier 13 senses a "dark" signal, the longitudinal motion is stopped and the detaching assembly 7 is raised until again a "light" signal is detected by the optical barrier 13. At the end of the pass, from the stored individual positions the obliquely oriented bale boundary 2*a* (correct contour) of the bale series 2 is calculated and in subsequent operation the machine is accordingly controlled. During the first pass fiber material may be detached from the working surface 2*a*.

Figure 3A:
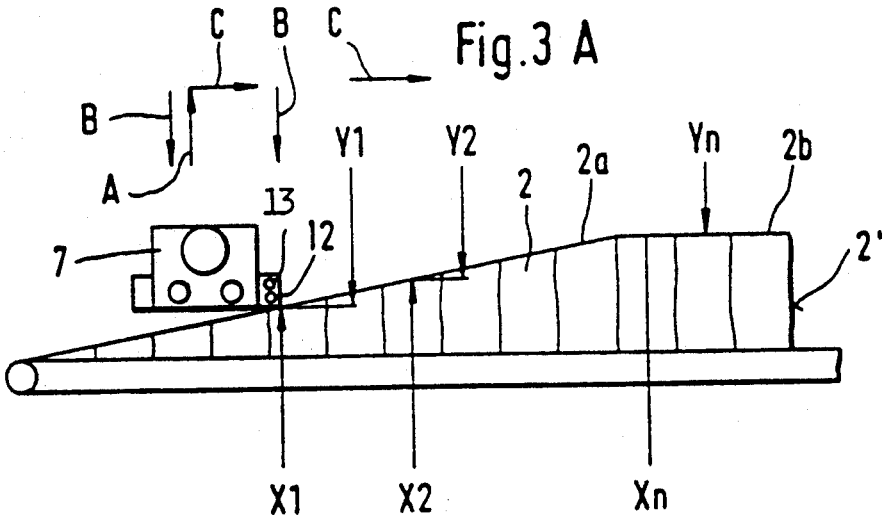
FIGS. 3A–3E are schematic side elevational views, illustrating, in particular, a lowering of sensors at different positions along the working path and a horizontal displacement of sensors.
Figure 3B:
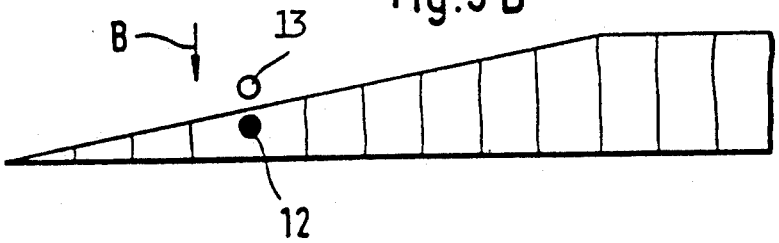
Figure 3C:
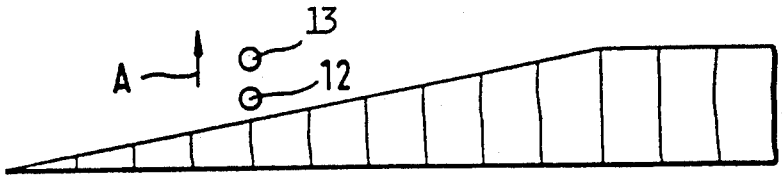
Figure 3D:
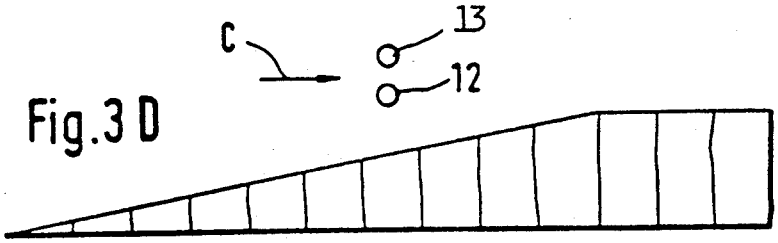
Figure 3E:
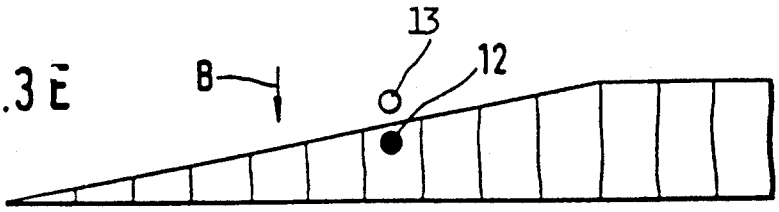
Figure 4A:
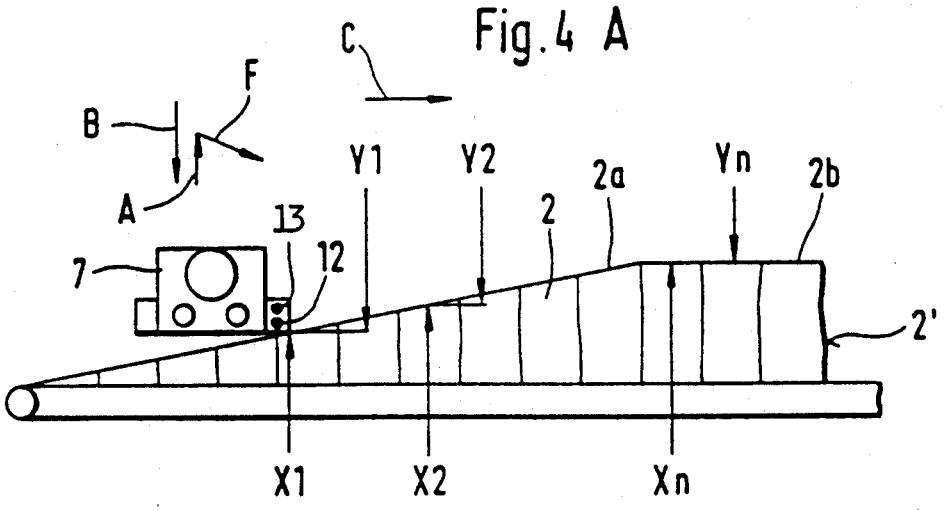
FIGS. 4A–4D are schematic side elevational views of the invention, showing in particular an inclined shift of sensors.
Figure 4B:
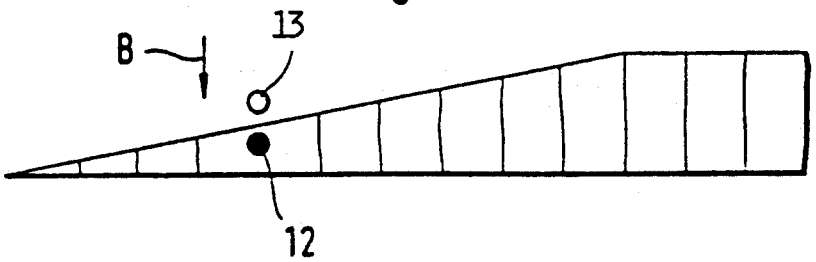
Figure 4C:
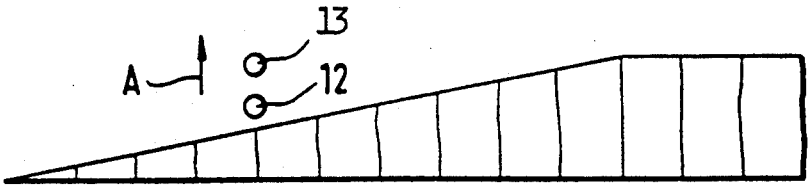
Figure 4D:
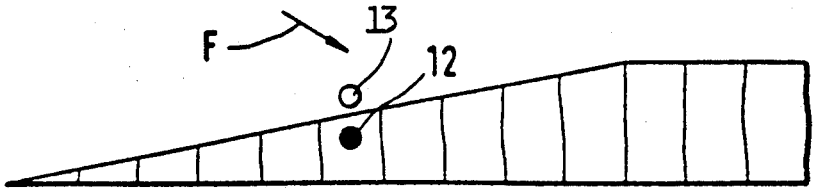

According to FIG. 3B, the detaching assembly 7 is lowered while at its starting position Xl, until the optical barrier 12 effects an interruption of the downward motion in the direction of the arrow B. Thereupon, such a height position (Y1) is stored. Thereafter the detaching assembly 7 is raised as indicated by the arrow A in FIG. 3C and the bale opener 1 is displaced to a predetermined extent in the longitudinal direction C until it reaches the location X2. Thereafter, the detaching assembly 7 is again lowered as indicated by the arrow B until the optical barrier 12 effects stoppage which occurs in position Y2 which is stored, together with the position X2. This procedure is repeated as often as necessary. At the end of the pass there is calculated the oblique bale surface boundary 2*a* (correct contour) from the stored individual values and the subsequent operation is accordingly controlled. In such a method the optical barrier 14 of the earlier-described embodiment shown in FIGS. 2A–2D may be dispensed with.

Turning now to FIGS. 4A–4D, the detaching assembly 7 is raised only to a small predetermined distance so that the optical barrier 12 again clearly detects a "light" signal. Further, during this procedure, the detaching assembly 7 is, during the longitudinal travel in the direction C, again slowly lowered until the optical barrier 12 effects interruption of this motion. In each instance the coordinate for such a position is stored. This procedure is repeated as often as necessary. At the end of the pass, from the stored individual values the oblique bale boundary 2*a* (correct contour) is calculated and the subsequent positioning accordingly controlled. This procedure has the advantage that fiber material may be detached from a new bale group which does not yet have an oblique working surface.

It is noted that in the FIGS. 1A–4C light barriers which detect a "light" signal are shown as an empty circle whereas light barriers which detect a "dark" signal are shown in black.

The optical barriers may be of the transmitted light type wherein the transmitter and receiver are disposed on opposite sides of the fiber bale series as illustrated in FIG. 1A or may be of the reflected light type in which case transmitter and receiver are situated next to one another on the same side of the fiber bale series.

Figure 5:
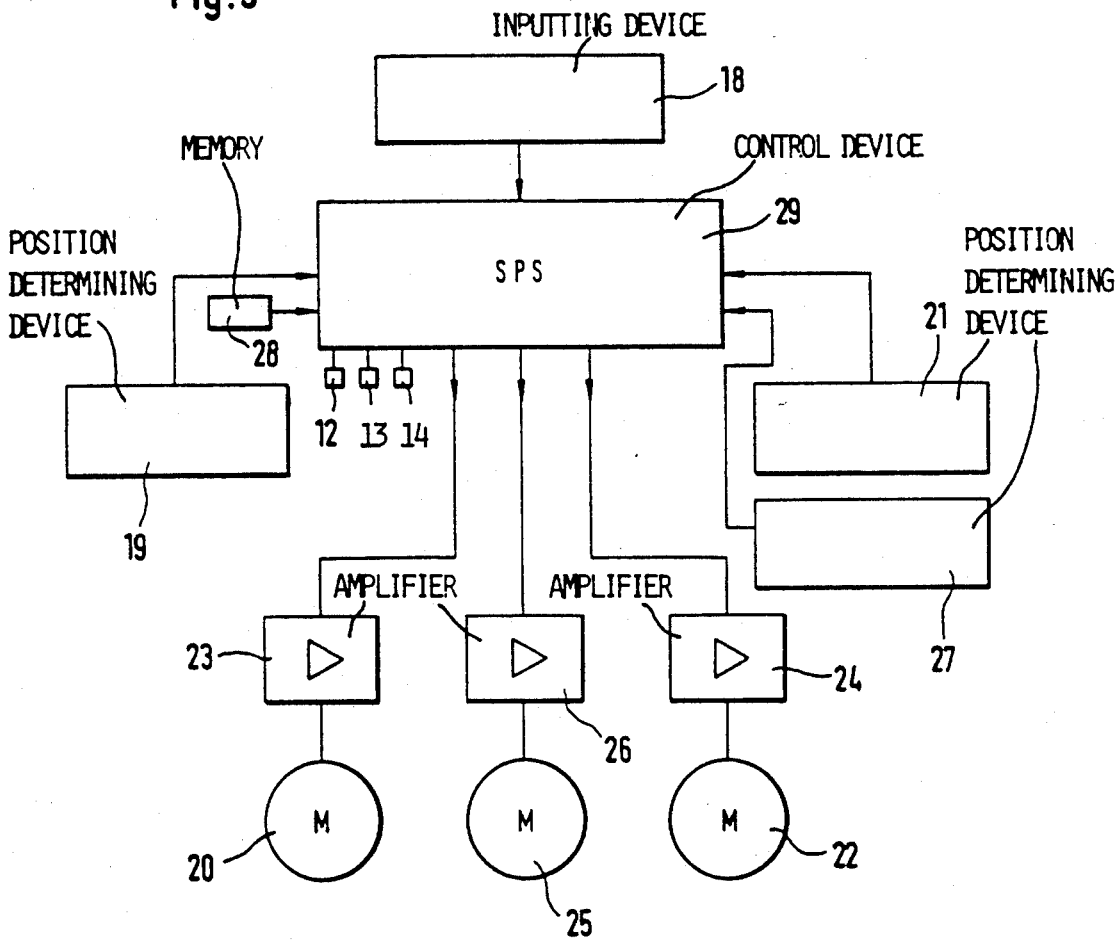
FIG. 5 is a block diagram for the electronic position sensing and control of the bale opener according to the invention.

Turning now to the block diagram of FIG. 5, there is illustrated therein a control device 29 such as a stored program control connected with an inputting device 18. A travel-position determining device 19, such as an incremental rotary transmitter or the like is arranged at the motor 20 (which propels the bale opener 1 along the fiber bales in directions C, C') for determining the longitudinal (X) coordinates and a position determining device 21 such as an incremental rotary transmitter arranged at the motor 22 (which vertically moves the detaching assembly 7 relative to the tower 4 in directions A, B) for determining the height (Y) coordinates. Furthermore, the control device 29 is connected with the intermediary of an amplifier 23 with the drive motor 20 and with the intermediary of an amplifier 24 with the lifting motor 22. Also, the following additional components are connected to the control device 29: a motor 25 which moves the detaching assembly 7 about a horizontal axis to execute pivotal motions as indicated by the arrows D, D' with the intermediary of an amplifier 26, a device 27 for determining the angular displacement of the detaching assembly 7, a memory 28 as well as the optical barriers 12, 13 and 14.

It will be understood that the above description of the present invention is susceptible to various modifications, changes and adaptations, and the same are intended to be comprehended within the meaning and range of equivalents of the appended claims.

What is claimed is:

1. A method of determining the inclination of an upper surface of a series of fiber bales by a bale opener travelling horizontally in a direction of travel along the bale series and having a tower and a detaching assembly mounted on the tower and being vertically displaceable relative to the tower and being rotatable about a horizontal axis oriented perpendicularly to the direction of travel; comprising the following steps:

(a) at a first location along the travelling path simultaneously lowering two bale surface level sensors spaced from one another in said travelling direction until a first of the two sensors is situated below the bale surface level;

(b) pivoting a second of the two sensors about a horizontal axis through a first pivot angle until said second sensor is situated below the bale surface level;

(c) moving the bale opener to a second location along said travelling path;

(d) repeating steps (a) and (b) at said second location; and (e) determining the angle of inclination of the bale surface from the coordinates of locations and the pivot angles of said second sensor.

2. A method of determining the inclination of an upper surface of a series of fiber bales by a bale opener travelling horizontally in a direction of travel along the bale series and having a tower and a detaching assembly mounted on the tower and being vertically displaceable relative to the tower and being rotatable about a horizontal axis oriented perpendicularly to the direction of travel; comprising the following steps:

(a) at different locations along the travelling path simultaneously lowering two vertically spaced bale surface level sensors until a lower of the two sensors is situated below the bale surface level; and (b) determining the angle of inclination of the bale surface from horizontal and vertical coordinates of said lower sensor.

3. A bale opener comprising (a) a tower arranged for horizontal travel in a travelling direction along a stationarily supported fiber bale series;

(b) a detaching assembly mounted on the tower and projecting laterally therefrom to extend above an upper surface of the bale series; said detaching assembly having an opening device for removing fiber tufts from the upper surface in an oblique plane during travel of the bale opener tower;

(c) at least two surface level sensors mounted on said detaching assembly for determining a height level of the upper surface at different locations during said horizontal travel of the bale opener;

(d) path sensor means for determining coordinates of said different locations; and (e) control means for determining the inclination of said upper surface from the height levels of said upper surface at said different locations; said surface level sensors and said path sensor means being connected to said control means.

4. A bale opener as defined in claim 3, wherein said two surface level sensors are spaced from one another in a vertical direction.

5. A bale opener as defined in claim 3, wherein said path sensor means includes an optical barrier mounted for co-travel with said detaching assembly.

6. A bale opener as defined in claim 3, wherein one of said surface level sensors is swingable about a horizontal axis oriented perpendicularly to said travelling direction; further comprising an angular displacement sensing means for determining an angle of displacement of said one surface level sensor; said angular displacement sensing means being connected to said control means.

7. A bale opener as defined in claim 3, further comprising a first motor means for propelling said tower along said path of travel, a second motor means for lifting said detaching assembly relative to said tower and a third motor means for pivoting said detaching assembly about said horizontal axis; said first, second and third motor means being connected to said control means.

8. A bale opener as defined in claim 3, further comprising a memory for storing coordinates of height levels of the upper surface and positions of said detaching assembly along the path of travel; said memory being connected to said control means.

9. A bale opener as defined in claim 8, wherein said memory is a buffered memory.

10. A bale opener as defined in claim 3, wherein said surface level sensors are two optical barriers each including a light transmitter directing a horizontal beam of light oriented perpendicularly to said travelling direction.

11. A bale opener as defined in claim 10, wherein said optical barriers are spaced from one another at an adjustable vertical distance.

12. A bale opener as defined in claim 10, wherein said optical barriers are vertically aligned with one another.

13. A bale opener as defined in claim 10, wherein said optical barriers are spaced from one another in said travelling direction.

14. A bale opener as defined in claim 10, wherein said detaching assembly has first and second opposite end walls oriented generally perpendicularly to said travelling direction; said optical barriers being mounted on said first end wall.

15. A bale opener as defined in claim 14, wherein said path sensor means includes a third optical barrier mounted on said second end wall of said detaching assembly.

* * * * *

UNITED STATES PATENT AND TRADEMARK OFFICE

CERTIFICATE OF CORRECTION

PATENT NO. : 5,189,308

DATED : February 23, 1993

INVENTOR(S) : Wolfgang Kortlang et al

It is certified that error appears in the above-indentified patent and that said Letters Patent is hereby corrected as shown below:

On the title page, item [54] and column 1, lines 2-5, the title of the invention should read --METHOD AND APPARATUS FOR OPERATING A BALE OPENER HAVING DUAL SENSORS CONNECTED TO A SURFACE INCLINATION CONTROL DEVICE--.

Signed and Sealed this

Fourteenth Day of December, 1993

*Attest:*

Bruce Lehman

BRUCE LEHMAN

*Attesting Officer*

*Commissioner of Patents and Trademarks*